US005961394A

United States Patent [19]

Minabe

[11] Patent Number: 5,961,394

[45] Date of Patent: Oct. 5, 1999

[54] GOLF CLUB

[75] Inventor: Matsuhiko Minabe, Toyama, Japan

[73] Assignee: Hokuriku Golf Works Co., Ltd., Toyama, Japan

[21] Appl. No.: 08/975,427

[22] Filed: Nov. 20, 1997

[30] Foreign Application Priority Data

Jun. 30, 1997 [JP] Japan ..... 9-190706

[51] Int. Cl.[6] ..... A63B 53/02; A63B 53/04

[52] U.S. Cl. ..... 473/305; 473/331; 473/345

[58] Field of Search ..... 473/345, 346, 473/331, 324, 305, 306, 307, 308, 309, 310, 311, 312, 313, 314, 315, 246, 248, 289, 290, 330

[56] References Cited

U.S. PATENT DOCUMENTS

| | | | |
|---|---|---|---|
| Re. 34,925 | 5/1995 | McKeighen | 473/345 |
| 4,438,931 | 3/1984 | Motomiya . | |
| 5,090,702 | 2/1992 | Viste | 473/331 |
| 5,221,086 | 6/1993 | Antonious | 473/327 |
| 5,232,224 | 8/1993 | Zeider . | |
| 5,346,217 | 9/1994 | Tsuchiya | 473/345 |
| 5,429,357 | 7/1995 | Kobayashi . | |
| 5,485,998 | 1/1996 | Kobayashi | 473/345 |
| 5,556,097 | 9/1996 | Endo | 473/345 |
| 5,575,723 | 11/1996 | Take | 473/345 |
| 5,704,850 | 1/1998 | Shieh | 473/345 |
| 5,766,089 | 6/1998 | Dekura | 473/305 |

FOREIGN PATENT DOCUMENTS

| | | |
|---|---|---|
| 61-33970 | 10/1986 | Japan . |
| 61-33971 | 10/1986 | Japan . |
| 61-33973 | 10/1986 | Japan . |
| 5-137818 | 6/1993 | Japan . |
| 6-142236 | 5/1994 | Japan . |

*Primary Examiner*—Sebastiano Passaniti
*Attorney, Agent, or Firm*—Frishauf, Holtz, Goodman, Langer & Chick, P.C.

[57] ABSTRACT

A golf club, comprises a face member, a hollow head body located behind the face member and having an opening for mounting the face member, a shaft-mounting pipe to be welded to the hollow head body, a shaft fixed to the shaft-mounting pipe and a pipe-retaining groove for retaining the shaft-mounting pipe in such a manner that the shaft-mounting pipe contacts a predetermined position on the hollow head body to which the shaft-mounting pipe is welded to thereby determine the fixing angle of the pipe with respect to the hollow head body. The fixing angle of the shaft mounting pipe is readily set in a state in which the pipe is held in contact with the pipe-retaining groove. The face member and the head body are made of a β-type titanium alloy, and the hollow head body has a substantially uniform thickness throughout the wall thereof and is thinner than the face member. The shaft-mounting pipe is welded to the pipe-retaining groove, and the face member is welded to the face member mounting portion of the hollow head body.

12 Claims, 5 Drawing Sheets

GOLF CLUB

FIELD OF THE INVENTION

The present invention relates to a golf club having a metallic wood comprising a metallic outer shell, and more particularly, to such type of golf club that has a head formed by welding together shell pieces pressed to predetermined shapes, respectively.

BACKGROUND OF THE INVENTION

As disclosed in Examined Published Japanese Utility Model Application Nos. 61-33970, 61-33971 and 61-33973 and U.S. Pat. No. 4,438,931 corresponding thereto, there has conventionally existed such type of metal wood that comprises a golf club head formed of a plurality of metallic shell pieces integrally welded together and a metallic face member welded thereto. Further, as disclosed in Unexamined Published Japanese Patent Application Nos. 5-137818 and 6-142236 and U.S. Pat. No. 5,429,357 corresponding thereto, there has been proposed such type of golf club that has a head having a front opening to which a face member made of a metallic plate is welded.

For manufacturing a golf club head comprising a plurality of metallic shell pieces integrally welded together, it has been usual that as disclosed in U.S. Pat. No. 5,232,224, the shell pieces are welded while they are fixed to a predetermined jig and in order to fix a shaft to such golf club head accurately, a shaft-mounting pipe fixed to a predetermined jig is welded to the golf club head while the fixing angle of the shaft-mounting pipe is adjusted.

In the case of the above-described conventional technology, where the shaft-mounting pipe for mounting a shaft to the golf club head is fixed to the golf club head, since the loft angle and the lie angle must be determined, a specific jig is required for the sake of accuracy of fixation and every time when the shaft-mounting pipe is welded to the golf club head, the fixing angle must be adjusted.

Moreover, it has been practiced that in view of the easiness of molding and weldability of the golf club head and the balancing of the center of gravity thereof, the thickness of the shell piece at the sole portion of the head is made thicker than the crown portion and pure titanium is used as a material for the golf club head. Accordingly, the conventional technology has had the disadvantage that the rigidity of the golf club head as a whole is not strong and when attempting to increase its rigidity, the thickness of each of the shell pieces for forming the head is forced to be made large which results in losing a favorable weight balance.

SUMMARY OF THE INVENTION

An object of the present invention is to provide a metallic golf club which has a high-degree of shaft-mounting accuracy and which can be manufactured with ease, and also to provide a method of manufacturing the same.

Another object of the present invention is to provide a metallic golf club which has a favorable weight balance and a high-degree of strength and which is light in weight.

The golf club according to the present invention comprises a face member, a hollow head body located behind the face member and having an opening for mounting the face member, a shaft-mounting pipe to be welded to the hollow head body, a shaft fixed to the shaft-mounting pipe and a pipe-retaining groove for retaining the shaft-mounting pipe in such a manner that the shaft-mounting pipe contacts a predetermined position on the hollow head body to which the shaft-mounting pipe is welded to thereby determine the fixing angle of the pipe with respect to the hollow head body wherein the fixing angle of the shaft mounting pipe is readily set in a state in which the pipe is held in contact with the pipe-retaining groove, the face member and the head body are made of a β-type titanium alloy, the hollow head body has a substantially uniform thickness throughout the wall thereof and is thinner than the face member, the shaft-mounting pipe is welded to the pipe-retaining groove, and the face member is welded to the face member mounting portion of the hollow head body.

The above-mentioned pipe-retaining groove is formed substantially semi-cylindrical so as to be brought into surface contact with the above-mentioned face member mounting portion of the hollow head body and the side surface of the shaft-mounting pipe and both side edges of the pipe-retaining groove are welded. Both the upper and rear surfaces of the face member are provided with pluralities of shallow parallel grooves, respectively. Further, the upper surface of the hollow head body is provided with convex-concave portions such as a plurality of grooves extending in a direction perpendicular to the face member.

DETAILED DESCRIPTION OF THE PREFERRED EMBODIMENTS

Figure 1:
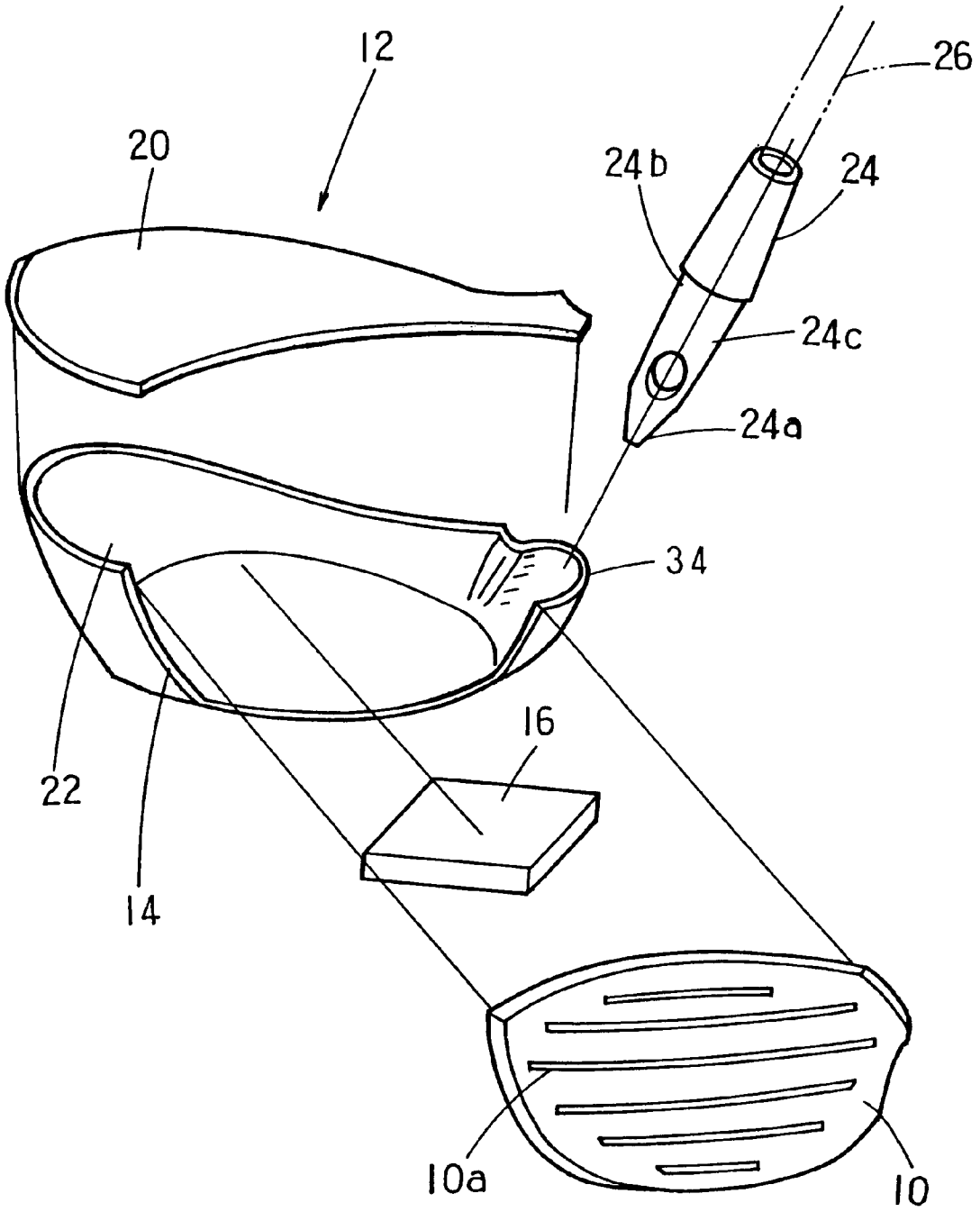
FIG. 1 is an exploded perspective view of a golf club head according to one embodiment of the present invention.
Figure 2:
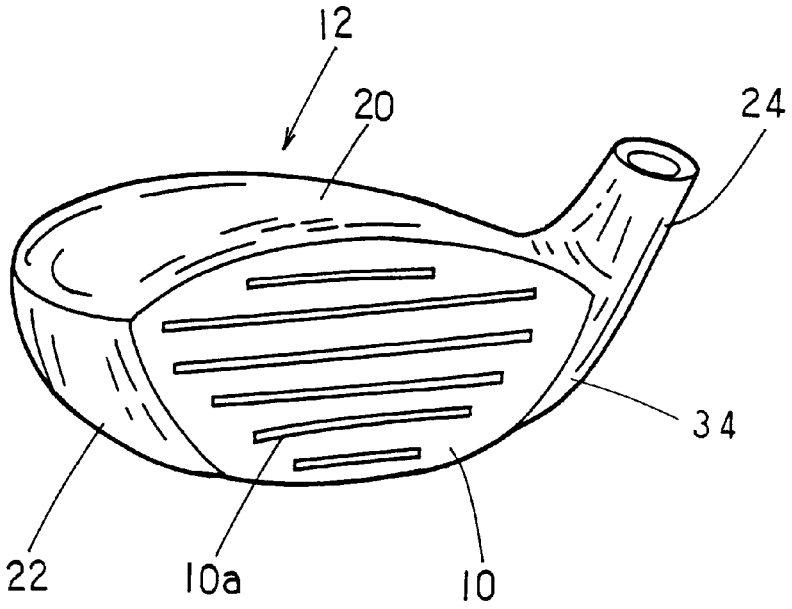
FIG. 2 is a perspective view of the golf club head shown in FIG. 1.
Figure 3:
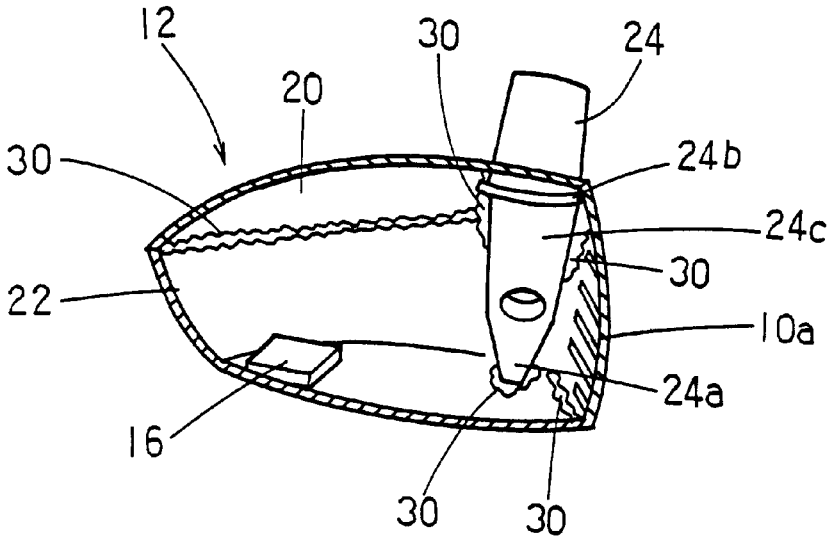
FIG. 3 is a vertical cross-sectional view of the golf club head shown in FIGS. 1 and 2.

The preferred embodiments of the present invention will now be described with reference to the accompanying drawings.

FIGS. 1 through 5 show a golf club head according to a first embodiment of the present invention. This golf club comprises a face member 10 for hitting a ball and a hollow head body 12. The face member 10 is provided with a plurality of shallow grooves 10*a* on the front and rear surfaces thereof, respectively, to thereby increase the strength thereof. Further, the face member 10 is integrally welded to a head body 12 along a face member fixing portion 14 at the peripheral edge of the head body 12. At a predetermined position within the head body 12, there is fixed a weight 16 for adjusting the center of gravity of the head body 12.

The head body 12 has an upper surface 20 which forms itself a substantially flat crown portion and a side peripheral bottom surface 22 including a sole portion and a side peripheral portion integrated with each other and welded portions 30 are formed as a result of welding the upper surface 20 to the periphery of the side peripheral bottom surface 22. Further, to the head body 12 there is integrally welded a shaft-mounting pipe 24 which, as shown in the drawings (see FIGS. 3 and 4) has its intermediate portion welded to the head body 12 (see the two upper welded portion 30) and its lower end portion 24*a* welded to the inner surface of the sole portion of the side peripheral bottom surface 22 to form another welded portion 30. An upper portion 24*b* of the pipe 24 is formed tubular by scooping out a titanium rod with the exception of the lower end portion 24*a* which is formed solid. In the shaft-mounting pipe 24 there is fitted a shaft 26 to thereby form a golf club. The shaft may be welded or bonded to the shaft-mounting pipe 24.

The portion of the side peripheral bottom surface 22 to which the shaft-mounting pipe 24 is fixed is provided with a semi-cylindrical pipe retaining groove 34 of a size large enough for a welded portion 24*c* of the shaft-mounting pipe 24 to fit therein. The pipe-retaining groove 34 has a diameter substantially equal to that of the welded portion 24*c* of the shaft-mounting pipe 24 and a length equal to the height of the side surface of the welded portion 24*c*.

The face member 10 is required to have a high degree of rigidity since it is a very portion for hitting a golf ball, so that it is made of a material selected from various kinds of β-type titanium alloys and has a suitable thickness in the range of between 2.5 and 3.5 mm. Further, the head body 12 is also made of a material selected from various kinds of β-type titanium alloys to a thickness of about 1.2 mm so as to reduce the weight thereof such that the upper surface 20 and the side peripheral bottom surface 22 have the same thickness. As the β-type titanium alloys, a Ti-22V-4A1 alloy is preferable but a Ti-13V-11Cr-3A1 alloy, a Ti-11.5Mo-6Zr-4.5Sn alloy and a Ti-15Mo-3Cr-3Sn-3A1 alloy or other titanium alloys may be selectively used according to their performances.

Figure 4:
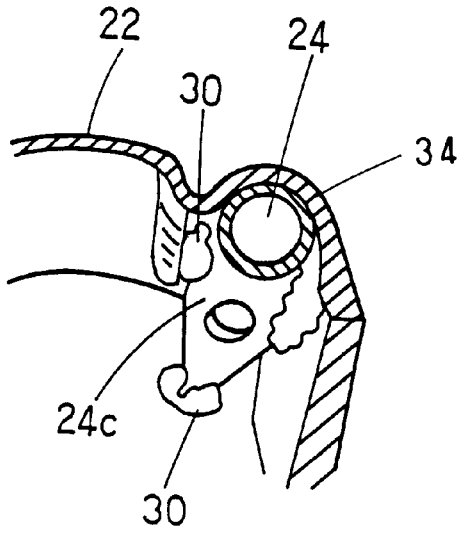
FIG. 4 is a horizontal cross-sectional view of a neck portion of the golf club head shown in FIGS. 1 through 3.

The method of manufacturing the above-described golf club head is performed such that the face member 10 is subjected to cold or hot forging to become plastically deformed to have a predetermined curved configuration and at the same time, a plurality of grooves 10*a* are formed on each of the front and rear surfaces ofthe face member 10. For forging, any suitable methods may be selectively used irrespective of either cold or hot forging. Further, the upper surface 20 and the side peripheral sole portion 22 are molded to predetermined shapes, respectively, by using a press. After that, as shown in FIG. 4, the shaft-mounting pipe 24 is fitted into the pipe-retaining groove 34 of the side peripheral bottom surface 22 of the head body 12 and the fixing angle of the shaft 26 with respect to the head body 12 is readily set up. Next, the side surface of the shaft-mounting pipe 24 and both side edges of the pipe-retaining groove 34 are welded together while holding them stationary by a jig (not shown). Further, the lower end of the shaft-mounting pipe 24 and the inner surface of the sole portion of the side peripheral bottom surface 22 are welded.

Figure 5:
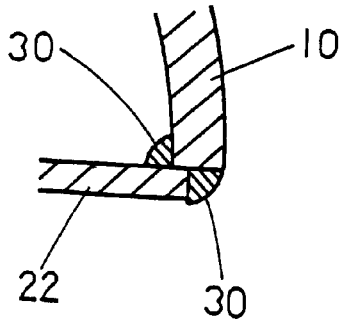
FIG. 5 is an enlarged vertical sectional view of a face member welded portion of the golf club head shown in FIGS. 1 through 4.

After that, the weight 16 is welded to the inside of the side peripheral bottom surface 22 and the face member 10 is welded to the face fixing portion 14 of the side spherical bottom surface 22. In this case, as shown in FIG. 5, the lower end of the face member 14 is fixed to the side peripheral bottom surface 22 by being fitted inside the face member 10 and the face angle is determined by the position at which the face member 10 is welded. The welding of the face member 10 is such that as shown in FIG. 5, the front and rear sides of the side peripheral surface of the face member 10 are welded to the side peripheral bottom surface 22 to form welded portions 30. The weight 16 may be welded in advance to the side peripheral bottom surface 22 but in that case, it should be welded while confirming the weight balance of the side peripheral bottom surface 22 after the shaft-mounting pipe 24 has been fixed. After that, the upper surface portion 20 is welded to the upper edge of the face member 10 and the upper edge of the side peripheral bottom surface 22 from outside. These welding operations may be performed by selectively using a laser welding method or an electron beam welding method and after that, the shaft 26 is inserted into the shaft-mounting pipe 24 and fixed with a bonding agent or the like.

The golf club in the instant embodiment is constructed by fitting the shaft-mounting pipe 24 into and welded to the pipe-retaining groove 34 formed at the side peripheral bottom surface 22 of the hollow head body 12 so that the shaft-mounting pipe 24 which is securely and accurately retained in the pipe-retaining groove 34 is positioned thereby enabling the pipe 24 to be securely fixed and welded at an accurate angle with respect to the head body 12 and with an increased strength. Further,since the hollow head body 12 is comparatively thin with the parts forming the body having substantially the same thickness and made of a material selected from various kinds of β-type titanium alloys, the center of gravity of the head body is located at a comparatively upper portion of the head body so that the hit ball is prevented from being blown up and it can draw an ideal parabolic ballistic curve, thereby extending its flying distance.

Figure 6:
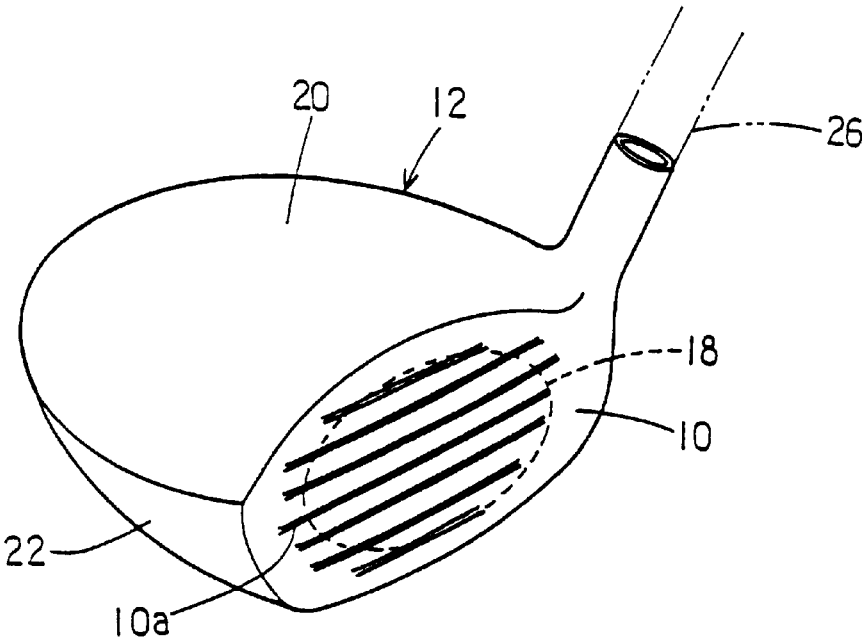
FIG. 6 is a perspective view of a golf club head according to a second embodiment of the present invention.
Figure 7A:
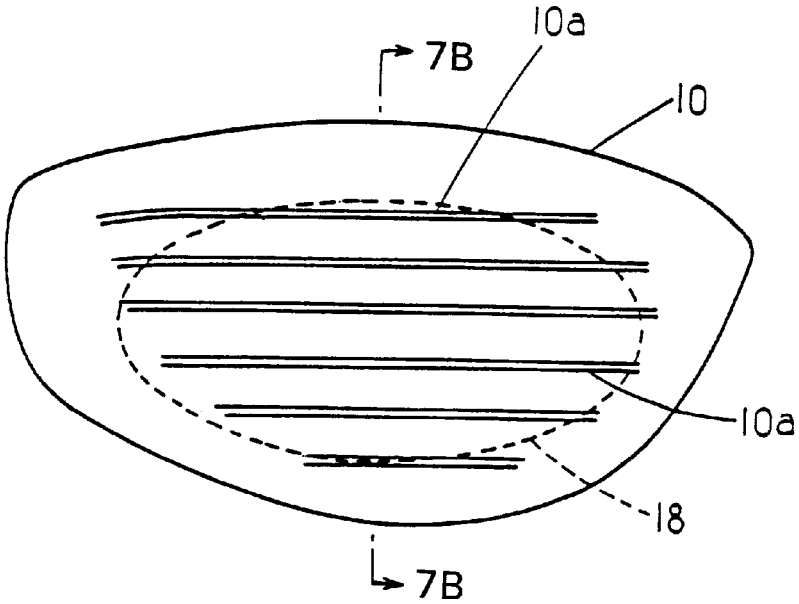
FIG. 7A is a front view of a face member of a golf club head shown in FIG. 6.
Figure 7B:
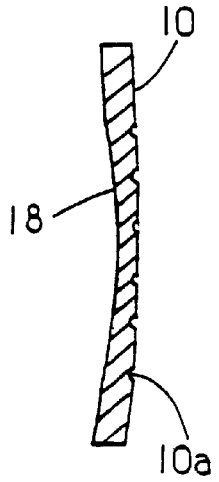
FIG. 7B is a sectional view taken along 7B—7B line of FIG. 7A.

Next, a golf club according to a second embodiment of the present invention will be described with reference to FIGS. 6 and 7, wherein like parts are designated by like reference numerals with respect to the above-described first embodiment for the sake of simplicity of description. In this embodiment, the face member 10 has a thin-wall portion 18 in the form of a concave lens on the rear surface thereof over a range covering a portion of the face member against which the hit ball frequently runs, or over a predetermined range from the central portion of the rear surface of the face member. This thin-wall portion 18 is subjected to a cutting process by using a numerical control machine or the like so that it becomes smaller in thickness toward the center thereof. The structure of the remaining parts and the method of assembling them are the same as in the case of the first embodiment.

The golf club according to this embodiment has the thin-wall portion 18 at the central portion of the face member 10 so that, for example, in contrast to the conventional face member having a thickness of 3 mm, the face member can have a thickness of about 2.7 mm at the central portion thereof which results in the advantages that the sweet spot of the face member 10 can be widened and the elasticity thereof can be increased and further that since the peripheral portion of the face member 10 is made so as to have a large thickness, the strength of the member can be secured. In addition, the face member 10 becomes light in weight and so the weight of the club head itself can be reduced by that degree.

Further, the face member 10 may be made thin in its entirety and a reinforcing ring member may be applied to the rear surface thereof. Thus, by so doing, it is possible to obtain the same effect as in the case of the above-described second embodiment.

Figure 8:
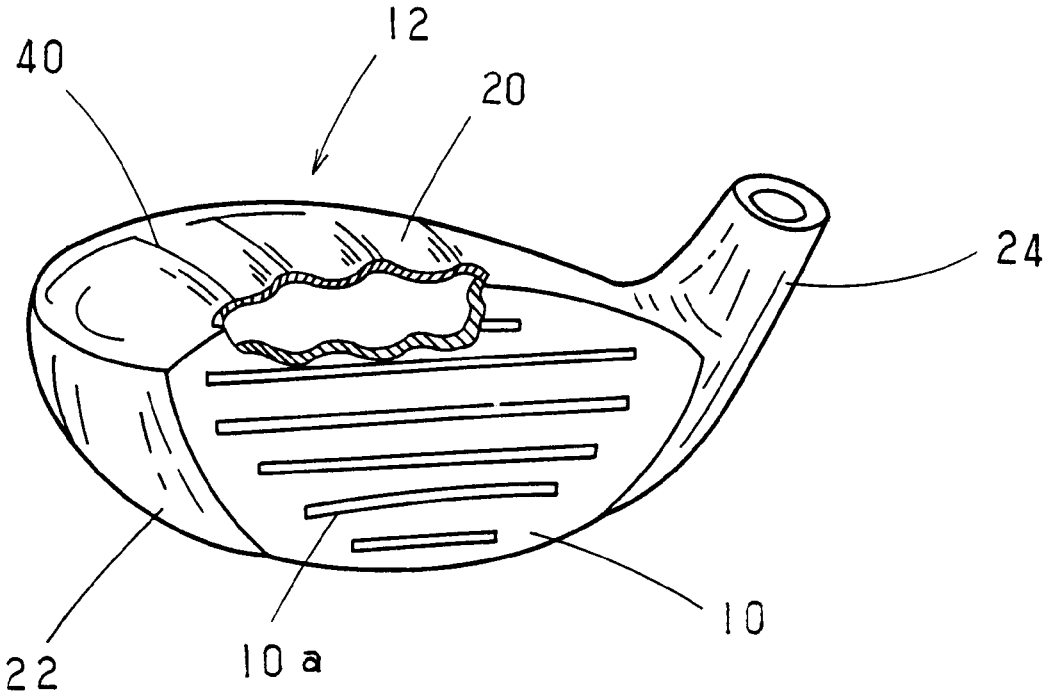
FIG. 8 is a perspective view (partially cut away) of a golf club head according to a third embodiment of the present invention.

Lastly, a golf club according to a third embodiment of the present invention will be described with reference to FIG. 8 wherein like parts are designated by like reference numerals with respect to the above-described embodiments for the sake of simplicity of description. In this embodiment, the upper surface 20 of the head body 12 is provided with a plurality of convex-concave portions 40 extending in a direction perpendicular to the face member 10. Further, the convex-concave portion 40 are formed by using a press, but they may be formed by cutting the upper surface 20 or by forming a plurality of fine grooves on that surface 20. The structure of the remaining parts and the method of assembling them are the same as in the cases of the former two embodiments.

The golf club according to this embodiment has the advantages that since the upper surface 20 of the club head is provided with the convex-concave portion 40 extending perpendicular to the face member 10, it is possible to increase the rigidity thereof without the necessity of increasing the weight thereof and to cause the golf ball to fly farther with ease.

While the invention has been described in detail and with reference to specific embodiments thereof, it will be apparent to those skilled in the art that various changes and modifications can be made therein without departing from the spirit and scope of the claimed invention.

What is claimed is:

1. A golf club, comprising:

a face member having front and rear surfaces;

a hollow head body located behind the face member and having an opening for mounting of the face member to the hollow head body, and the hollow head body having an upper surface portion;

a shaft-mounting pipe welded to the hollow head body at positions below the upper surface portion of the hollow head body, such that a portion of the shaft-mounting pipe extends above the upper surface portion of the hollow head body;

said hollow head body having an outwardly projecting pipe-retaining groove at a side portion of the hollow head body for retaining the shaft-mounting pipe such that the shaft-mounting pipe contacts a predetermined position on the hollow head body to which the shaft-mounting pipe is welded, to thereby determine a fixing angle of the shaft-mounting pipe with respect to the hollow head body; and a shaft fixedly connected to the shaft-mounting pipe;

wherein:

the fixing angle of the shaft-mounting pipe relative to the hollow head body is set in a state in which the shaft-mounting pipe is held in surface contact with the pipe-retaining groove, the face member and the hollow head body are made of a β-type titanium alloy, the face member is welded to face member mounting portions of the hollow head body, the hollow head body has walls which have a substantially uniform thickness throughout, and the walls are thinner than the face member, the pipe-retaining groove is substantially so as to be in surface contact with the semi-cylindrical pipe-retaining groove having two side edges where the groove outwardly projects from the side portion of the hollow head body, the shaft-mounting pipe having intermediate side surface portions which are welded to both side edges of the pipe-retaining groove, respectively, and the pipe-retaining groove and the shaft-mounting pipe are welded together at intermediate areas along the length of the shaft-mounting pipe, which intermediate areas are below the upper surface portion of the hollow head body and interior of the hollow head body.

2. A golf club according to claim 1, wherein said front and rear surfaces of said face member each have a plurality of shallow grooves therein.

3. A golf club according to claim 2, wherein said shallow grooves are substantially parallel.

4. A golf club according to claim 1, wherein said front surface of said face member has a plurality of shallow grooves therein.

5. A golf club according to claim 4, wherein said shallow grooves are substantially parallel.

6. A golf club according to claim 1, wherein:

said face member has a central portion and peripheral edge portions; and said face member has a rear surface which is made so as to have a thin-wall portion over a predetermined area ranging from the central portion of said face member, which thin-wall portion is thinner than the peripheral edge portions of said face member.

7. A golf club according to claim 1, wherein the upper surface portion of the hollow head body has a plurality of convex and concave portions extending in a direction intersecting at right angles with said face member.

8. A golf club according to claim 7, wherein:

the upper surface portion of the hollow head body is welded to a side peripheral bottom portion of the hollow head body; and the upper surface portion has said plurality of convex and concave portions formed therein.

9. A golf club according to claim 1, wherein said shaft is bonded to said shaft-mounting pipe with a bonding agent.

10. A golf club according to claim 1, wherein said shaft is welded to said shaft-mounting pipe.

11. A golf club according to claim 1, wherein said shaft-mounting pipe is solid in the area where it contacts said pipe-retaining groove.

12. A golf club according to claim 1, wherein the hollow head body has a sole portion at the lower end thereof, and wherein the shaft-mounting pipe is further welded to the sole portion at a position interior of the hollow head body.

* * * * *